US010456809B1

(12) United States Patent
Nagel

(10) Patent No.: US 10,456,809 B1
(45) Date of Patent: Oct. 29, 2019

(54) VIBRATING SCREEN FOR AN INLET HOPPER OF A CONVEYOR

(71) Applicant: Conrad Leon Nagel, Mossbank (CA)

(72) Inventor: Conrad Leon Nagel, Mossbank (CA)

( * ) Notice: Subject to any disclaimer, the term of this patent is extended or adjusted under 35 U.S.C. 154(b) by 0 days.

(21) Appl. No.: 15/471,094

(22) Filed: Mar. 28, 2017

(51) Int. Cl.
*B07B 1/28* (2006.01)
*B07B 1/36* (2006.01)

(52) U.S. Cl.
CPC ..... *B07B 1/284* (2013.01); *B07B 1/36* (2013.01)

(58) Field of Classification Search
CPC .... B07B 1/28; B07B 1/30; B07B 1/42; B07B 2201/02; B07B 1/284; B07B 1/36
USPC ..... 209/244, 245, 319, 405, 408, 409, 412, 209/415
See application file for complete search history.

(56) References Cited

U.S. PATENT DOCUMENTS 1,218,782 A * 3/1917 Larkin ..... B07B 13/16 209/241
3,439,806 A * 4/1969 Kass ..... B07B 1/005 209/260
3,491,881 A * 1/1970 Winquist ..... B06B 1/16 184/11.1
3,693,793 A * 9/1972 Hahn ..... B07B 1/284 209/326
4,055,251 A * 10/1977 Pieton ..... A01D 45/00 209/219
4,095,705 A 6/1978 Hood
4,420,391 A * 12/1983 Sharki ..... B01D 35/20 209/399
6,135,020 A * 10/2000 Broyles ..... A23N 5/01 426/481
7,581,646 B2 * 9/2009 Barr ..... A23N 15/025 209/235
7,591,377 B2 * 9/2009 Puda ..... B07B 1/005 209/309
9,259,740 B1 * 2/2016 Rieck ..... B03B 4/00
2008/0217219 A1 * 9/2008 Naberg ..... B07B 1/42 209/698

* cited by examiner

*Primary Examiner* — Joseph C Rodriguez
(74) *Attorney, Agent, or Firm* — Ryan W. Dupuis; Ade + Company Inc.; Kyle R. Satterthwaite

(57) ABSTRACT

A vibrating screen for screening particulate material fed into an inlet hopper of a conveyor features a screen comprising a first mesh portion locating openings therein that are sized for receiving individual particles of the particulate material therethrough. The vibrating screen includes a mounting assembly arranged for removably mounting to the inlet hopper that features a frame sized and shaped to be contained within the inlet hopper at a location above the conveyor so as to be supported thereabove by engagement with the side walls of the inlet hopper. The vibrating screen also features a suspension system resiliently supporting the screen on the mounting assembly such that the screen spans across at least a portion of an inlet opening at a top of the inlet hopper. A vibrating device supported on the screen is arranged for vibrating the screen relative to the inlet hopper of the conveyor.

18 Claims, 2 Drawing Sheets

VIBRATING SCREEN FOR AN INLET HOPPER OF A CONVEYOR

FIELD OF THE INVENTION

The present invention relates generally to a vibrating screen for screening particulate material, and more particularly the present invention relates to a vibrating screen arranged to be supported across an inlet of a loading hopper of a conveyor for screening particulate material as the particulate material is loaded into the conveyor.

BACKGROUND

Fertilizer is commonplace on farms for enhancing growth of crops. The fertilizer is typically stored in bulk in large containers. The fertilizer is then loaded onto another piece of equipment such as a trailer, tractor, or truck when the fertilizer is to be applied to the crops.

Loading of the fertilizer from its storage container to another piece of equipment may be achieved by discharging the fertilizer into an inlet hopper of a conveyor that is below a discharge opening of the storage container. The conveyor then delivers the fertilizer to the piece of equipment.

During storage, the fertilizer which is typically in particulate form may have tendency to form clumps which are not suitable for application to the field. Clumps may form due to moisture which hardens loose fertilizer particles together. Furthermore, discharge of the loose fertilizer particles from the respective storage container may cause bridging which may block the inlet hopper.

For example, U.S. Pat. No. 7,591,377 to Puda et al. teaches a method and apparatus for a vibrating screen aggregate separator which separates finer grained material from aggregate material that may contain a variety of undesired materials. The patent to Puda may have some potential shortcomings including that the vibrating screen is coupled to a container in such a manner that the screen may not be readily decoupled therefrom.

U.S. Pat. No. 4,095,705 to Hood describes an agricultural airplane loading device comprising a screen mounted on a hopper an auger. The loading device is for loading material into a reservoir of an airplane. The loading device comprises a pulley arranged for rotating the auger and a mass disposed eccentrically relative to the pulley for generally vibrating the hopper. Vibrations of the hopper are conducive to vibrating of the screen mounted thereto; however, the vibration is limited because the screen is fixed to the hopper which is in turn fixed to a hopper frame.

The Applicant provides a unique solution for an inlet hopper of a conveyor for screening particulate material fed into the inlet hopper of the conveyor. The Applicant's solution may overcome the potential shortcomings of the prior art references.

SUMMARY OF THE INVENTION

According to one aspect of the invention there is provided a vibrating screen for screening particulate material fed into an inlet hopper of a conveyor having upper edges around a periphery of the inlet hopper that delimit an inlet opening at or adjacent a top of the inlet hopper, the vibrating screen comprising:

a screen spanning longitudinally between first and second screen ends and laterally between opposing screen sides which join the first and second screen ends, the screen having openings sized to receive at least individual particles of the particulate material therethrough;

a mounting assembly arranged for removably mounting to the inlet hopper of the conveyor;

a suspension system resiliently supporting the screen on the mounting assembly such that the screen spans across at least a portion of the inlet opening;

a vibrating device arranged for vibrating the screen relative to the inlet hopper of the conveyor.

The embodiment as described in more detail hereinafter affords screening of particulate material such as fertilizer prior to loading the material onto another piece of equipment by providing a vibrating screen removably mounted in the inlet opening of the inlet hopper for the conveyor, which loads the material generally from its storage container onto a trailer, tractor, or truck, for example. Vibration of the screen effects breaking apart of fertilizer particles which are loose that have bridged on the screen. The loose fertilizer particles pass through a first mesh portion of the screen into the inlet hopper below for the conveyor to load the fertilizer particles. Clumps of fertilizer typically are resistant to breaking down due to the vibration of the screen into sufficiently loose particles so as to pass through the screen. Configuring the screen at in an inclined position such that the first screen end is elevated relative to the second screen end effects movement of the clumps of fertilizer due to the vibration of the screen in a direction generally towards the second screen end where the clumps are guided by side flanges and a second portion free of openings (or having openings sized smaller than the individual particles) at the second screen end into a receptacle below the screen. Furthermore, the vibrating device is supported on the screen such that the screen vibrates relative to the inlet hopper of the conveyor so as to provide a greater degree of vibration compared to the limited amount of vibration permitted by the prior art references.

Preferably, the mounting assembly comprises mounting elements at least substantially above the screen and the suspension system comprises a plurality of resilient elements at spaced locations about the screen, the resilient elements extending downwardly from the mounting elements to the screen. It is preferable that the mounting elements are located outwardly of an outer periphery of the screen collectively defined by the first and second screen ends and the screen sides and the resilient elements also extend inwardly from the mounting elements to the screen. In one instance, the resilient elements comprise springs.

Preferably, the vibrating device comprises a motor and an eccentric mass supported on the screen.

When the inlet hopper comprises side walls locating the upper edges at respective tops thereof, it is preferable that the mounting assembly comprises a frame which is sized and shaped to be contained within the inlet hopper at a location above the conveyor so as to be supported thereabove by engagement with the side walls of the inlet hopper. When each side wall of the inlet hopper has an upper portion, a lower portion, and an inner shoulder intermediate therebetween extending inwardly from the upper portion of the respective side wall to the lower portion thereof, and when the inlet hopper further comprises a first inner dimension between the upper portions of the side walls and a second inner dimension between the lower portions of the side walls, the frame of the mounting assembly is sized smaller than the first inner dimension and larger than the second inner dimension so as to rest on the inner shoulders of the inlet hopper.

Preferably, the screen further comprises a first mesh portion within the outer periphery of the screen and side flanges along the outer periphery of the screen, the side flanges extending upwardly from the first mesh portion. Optionally, the side flanges taper inwards from the screen sides towards one another.

When the screen comprises the first mesh portion, it is preferable that the screen also includes a second portion extending outwardly from the first mesh portion at or adjacent the second screen end and having a free edge for guiding material into a receptacle below the screen, the second portion being free of openings or having openings sized smaller than the individual particles of the particulate material so as to resist passage of the individual particles therethrough.

Preferably, the first screen end is elevated relative to the second screen end. Preferably, at least one of the first or second screen ends is arranged to be raised or lowered such that the slope is adjustable.

According to another aspect of the invention there is provided a vibrating screen for screening particulate material fed into a conveyor, the vibrating screen comprising:

a screen spanning longitudinally between first and second screen ends and laterally between opposing screen sides which join the first and second screen ends, the screen having openings sized to receive at least individual particles of the particulate material therethrough;

a mounting assembly arranged to be supported above the conveyor, the mounting assembly comprising mounting elements at least substantially above the screen;

a plurality of resilient elements at spaced locations about the screen extending downwardly from the mounting elements to the screen such that the screen is supported to span over a portion of the conveyor;

a vibrating device arranged for vibrating the screen relative to the mounting assembly.

Preferably, the mounting elements are located outwardly of an outer periphery of the screen collectively defined by the first and second screen ends and the screen sides and the resilient elements also extend inwardly from the mounting elements to the screen.

In one instance, the resilient elements comprise springs.

Preferably, the first screen end is elevated relative to the second screen end at a slope. It is preferable that at least one of the first or second screen ends is arranged to be raised or lowered such that the slope is adjustable.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
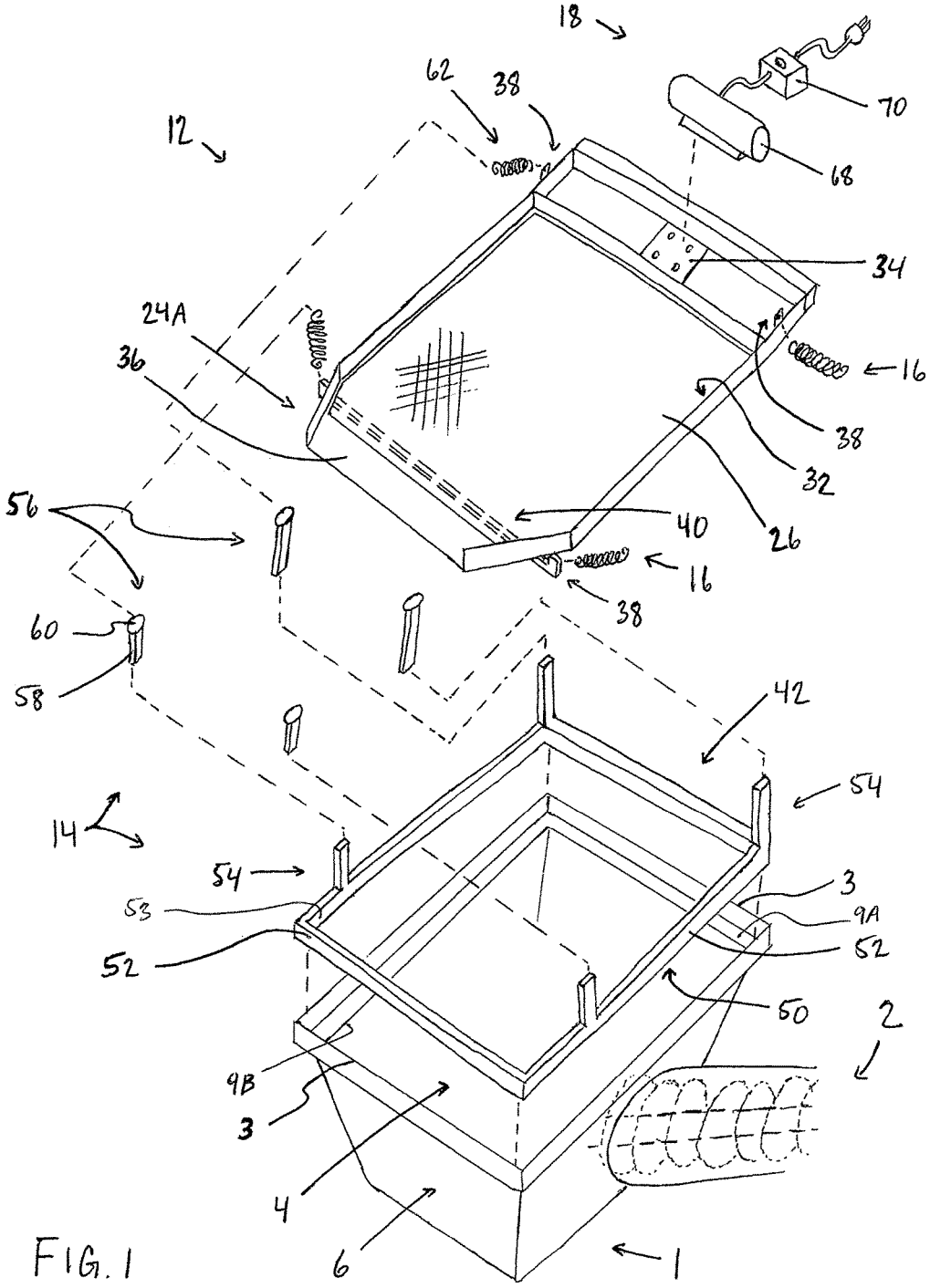
FIG. 1 is an exploded view of the vibrating screen for the inlet hopper of the conveyor.
Figure 2:
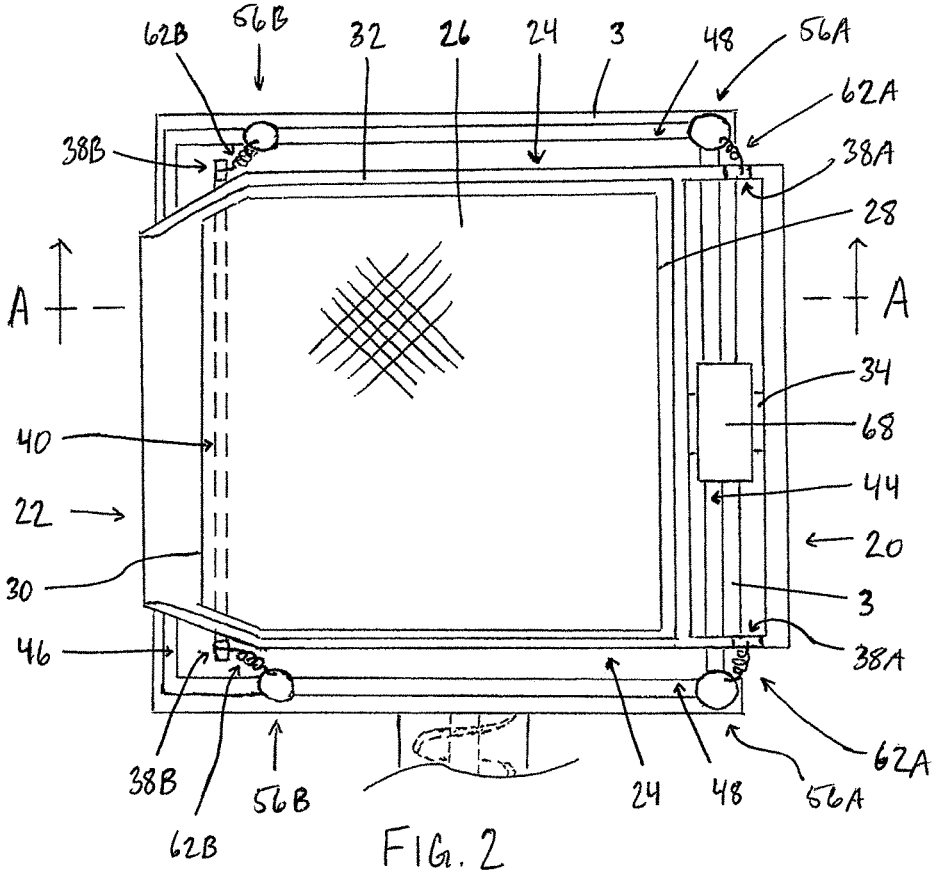
FIG. 2 is a top plan view of the vibrating screen in FIG. 1 mounted in the inlet hopper of the conveyor.

Referring to the accompanying figures, there is generally illustrated a vibrating screen indicated by reference numeral 10. The vibrating screen is suited for screening particulate material fed into an inlet hopper 1 of a conveyor 2. The conveyor typically comprises a tube portion extending outwardly and typically upwardly from the inlet hopper and a working portion in the tube portion for conveying the particulate material thereon from inlet hopper to another location. The working portion of the conveyor may comprise a belt or an auger as shown in FIGS. 1-2.

The inlet hopper has upper edges 3 around a periphery of the inlet hopper that delimit an inlet opening 4 at a top of the inlet hopper. The periphery of the inlet hopper is rectangular in plan view. The inlet hopper also has side walls 6 locating the upper edges at respective tops thereof. The side walls extend downwardly from the inlet opening to a discharge opening thereunder. The side walls also taper inwardly towards transversely opposing ones thereof as the side walls extend from the inlet opening to the discharge opening. Each side wall has an upper portion 7A, a lower portion 7B, and an inner shoulder 8 intermediate therebetween extending inwardly from the upper portion to the lower portion so as to form an inner ledge around the periphery of the inlet hopper. The inner shoulders are located closer to the upper edges than to the discharge opening. As shown more clearly in FIG. 3, the inner shoulders 8 extend inwardly from the upper portions 7A at locations spaced below the upper edges 3. The inner shoulders 8 define upper support surfaces 9A and terminate at inner edges 9B that delimit an opening sized smaller than the inlet opening 4. Furthermore, the inlet hopper has a first set of inner dimensions between the upper portions of respective pairs of opposing side walls and a second set of inner dimensions between the lower portions of respective pairs of opposing side walls. The inlet opening, side walls, and discharge opening collectively define a funnel structure. The auger is situated below the discharge opening.

Turning now to the vibrating screen, the vibrating screen generally comprises a screen 12, a mounting assembly 14, a suspension system 16, and a vibrating device 18.

The screen comprises a screen frame spanning longitudinally between first 20 and second 22 screen ends and laterally between opposing screen sides 24 which join the first and second screen ends. The first and second screen ends and the screen sides collectively define an outer periphery of the screen. In the illustrated embodiment, the outer periphery of the screen is generally rectangular, with end portions 24A of respective screen sides tapered inwards towards one another at a location closer to the second screen end 22 than to the first screen end 20 such that the second screen end is shorter than the first screen end as measured in a lateral direction between the screen sides.

The screen also includes a first mesh portion 26 within the outer periphery of the screen. The first mesh portion locates a plurality of openings therein that are sized to receive generally loose particulate material (e.g., fertilizer particles) therethrough while resisting passage of clumps of the particulate material through the openings. In the illustrated embodiment, the first mesh portion comprises a metallic material arranged in a grid pattern which defines the openings in the first mesh portion.

The first mesh portion spans a majority of the screen between a first end 28 adjacent the first screen end 20 and a second end 30 adjacent the second screen end 22. The first mesh portion is substantially enclosed by side flanges 32 of the screen generally along the outer periphery of the screen. More specifically, the side flanges are substantially aligned with the screen sides 24 and the first end 28 of the first mesh portion so as to extend upwardly from the first mesh portion. The side flanges are arranged to contain the particulate material generally over the first mesh portion and prevent the particles from spilling generally over the outer periphery of the screen.

The screen further comprises a mounting plate 34 for mounting the vibrating device 18 thereto. The mounting plate spans longitudinally between the first end 28 of the first mesh portion and the first screen end 20.

The screen also comprises a second portion 36 spanning longitudinally between the second end 30 of the first mesh portion and the second screen end 22 and laterally between the end portions 24A of the screen sides that are tapered. The second portion extends longitudinally outwardly from the first mesh portion. The second portion is free of openings and is a smooth and uninterrupted planar surface in the illustrated embodiment. The second portion has a free edge and is arranged for guiding material into a receptacle below the screen. In the illustrated embodiment, the screen is arranged in an inclined position as more clearly shown in FIG. 3 such that the first screen end 20 is elevated relative to the second screen end 22 at a slope for conducing movement of the clumps generally off of the screen and into the receptacle below the screen.

The screen further comprises attachment flanges 38 for attaching the suspension system thereto. A first pair 38A of attachment flanges is supported respectively on the screen sides at respective locations intermediate the first end 28 of the first mesh portion and the first screen end 20. A second pair 38B of attachment flanges are supported at opposite ends of an elongate attachment member 40 spanning laterally across the screen frame. The attachment member is coupled below the first mesh portion 26 at a longitudinal location between the tapered end portions 24A of the screen sides so as to be closer to the second screen end 22 than to the first screen end 20. The attachment flanges extend upwardly from the respective locations thereof in the illustrated embodiment.

Turning now to the mounting assembly 14, the mounting assembly is arranged for removably mounting to the inlet hopper 1 of the auger. The mounting assembly comprises a frame 42 which is sized and shaped to be contained within the inlet hopper at a location above the auger so as to be supported thereover by engagement with the side walls 6 of the inlet hopper. Furthermore, the frame of the mounting assembly is sized (in the longitudinal and lateral directions) smaller than the first set of inner dimensions and larger than the second set of inner dimensions so as to rest on the inner shoulders 8 of the inlet hopper.

The frame extends longitudinally between opposing first 44 and second 46 frame end portions and laterally between frame side portions 48 which join the first and second frame end portions. The first and second frame end portions and the frame side portions collectively define a periphery of the frame. The frame also has a bottom surface 50 along the periphery thereof that is arranged for resting on the inner shoulders of the inlet hopper. Outer dimensions of the frame measured between respective pairs of opposing outer sides 52 of corresponding portions of the frame are sized slightly smaller than the corresponding one of the first set of inner dimensions of the inlet hopper. That is, the outer sides of the first and second frame end portions have a first outer dimension sized slightly smaller than the corresponding first one of the first set of inner dimensions at the upper portions of the corresponding side walls. Further, the outer sides of the frame side portions have a second outer dimension sized slightly smaller than the corresponding second one of the first set of inner dimensions at the upper portions of the corresponding side walls. Yet further, as shown more clearly in FIG. 1 an inner side 53 of the frame defined inwardly of the bottom surface 50 and opposite to the outer sides 52 delimits an opening through which the particulate material can pass from the screen 12 to the inlet hopper 1. Also, each one of the first and second frame end portions and the frame side portions are tubular.

The mounting assembly also includes a plurality of upright members 54 at spaced locations around the periphery of the frame. The upright members extend vertically upwardly from the frame. A first pair 54A of the upright members are located respectively at corners where the first frame end portion 44 meets respective frame side portions 48. A second pair 54B of the upright members are located respectively along respective frame side portions closer to the second frame end portion 46 than to the first frame end portion. The first pair 54A of upright members extend further upwardly than the second pair 54B of upright members. Each one of the upright members is tubular along at least a portion of its length comprising an open end at a top of each upright member.

The mounting assembly further comprises a plurality of posts 56. Each post is vertically elongate and has a main portion 58 slidably received in a respective upright member 54 in a working position. Each post also includes an upper portion 60 at a top of the main portion. The upper portion is substantially disc shaped in plan view. A first pair 56A of the posts is received in the first pair 54A of upright members, and a second pair 56B of the posts is received in the second pair of upright members. The upper portions of the posts define screen mounting elements of the mounting assembly for mounting the screen thereto via the suspension system and suspending the screen from the mounting assembly.

Turning now to the suspension system 16, the suspension system comprises a plurality of springs 62. The springs define resilient elements of the suspension system. Each spring extends between a respective post 56, which is received in a corresponding upright member 54 of the mounting assembly, and a corresponding attachment flange 38 of the screen so that the screen is resiliently supported on the mounting assembly such that the screen spans across at least a portion of the inlet opening of the inlet hopper.

Each spring has a first spring end 64 supported on the upper portion 60 of the respective post 56 and a second spring end 66 supported on the corresponding attachment flange 38. Each one of a first pair 62A of the springs extends between one of the first pair 56A of posts and a corresponding one of the first pair 38A of attachment flanges. The first pair 62A of springs extends longitudinally outwardly and laterally inwardly from the first pair 56A of posts in the working position towards the first pair of attachment flanges 38A. Furthermore, each one of a second pair 62B of the springs extends between one of the second pair 56B of posts and one of the second pair 38B of attachment flanges. Similarly to the first pair of springs, the second pair 62B of springs extends longitudinally outwardly and laterally inwardly from the second pair 56B of posts in the working position towards the second pair 38B of attachment flanges. Consequently, the screen is suspended from the posts of the mounting assembly by the springs of the suspension system.

When the screen, mounting assembly, and the suspension system are coupled together in the illustrated embodiment as described above, the frame 42 of the mounting assembly is generally below the screen 12. The screen is above the upper edges 3 of the inlet hopper and extends longitudinally beyond the frame and the upper edges of the inlet hopper. The first screen end 20 is longitudinally outward of the first frame end portion 44 and the second screen end 22 is longitudinally outward of the second frame end portion 46. In an equilibrium position of the screen when same is substantially still, the first end 28 of the first mesh portion is located longitudinally inwardly of the first frame end portion 44 so as to be over the inlet opening, and the second end 30 of the first mesh portion is located longitudinally inwardly of the second frame end portion 46 in the illustrated embodiment. Furthermore, the screen sides 24 are laterally inward of respective frame side portions 48 and respective upright members 54 on corresponding frame side portions.

Each upright member 54 has a coupled end at the frame 42 that is substantially below the screen and the open end that is above the screen at a location along the screen laterally across from the respective upright member. The first pair 54A of upright members are located, along a longitudinal direction, generally intermediate the first end 28 of the first mesh portion and the first screen end 20, and more particularly the first pair of upright members are located intermediate the first end of the first mesh portion and the first pair 38A of attachment flanges. Furthermore, the second pair 54B of upright members are located longitudinally inwardly from the second pair of attachment flanges 38B (that are on the attachment member) at a location closer to the second pair of attachment flanges than to the first pair thereof.

When each post 56 is received in the corresponding upright member 54 in the working position, the upper portion 60 of each post is above the screen at a location along the screen laterally across from the respective post. In the illustrated embodiment, the upper portion of each post has a hole adjacent a circular peripheral edge of the upper portion. The first spring end 64 of each spring is arranged to be attached at the hole of the upper portion.

In the illustrated embodiment, either one of the first or second screen ends can be raised or lowered such that the slope of the inclined position of the screen is adjustable. The slope may be adjusted by changing elevation of one pair of posts relative to the other pair through addition of vertical spacing elements received in the corresponding pair of upright members. Additionally, the slope may be adjusted by replacing at least one of the pairs of springs with another pair of springs which is different in length.

Figure 3:
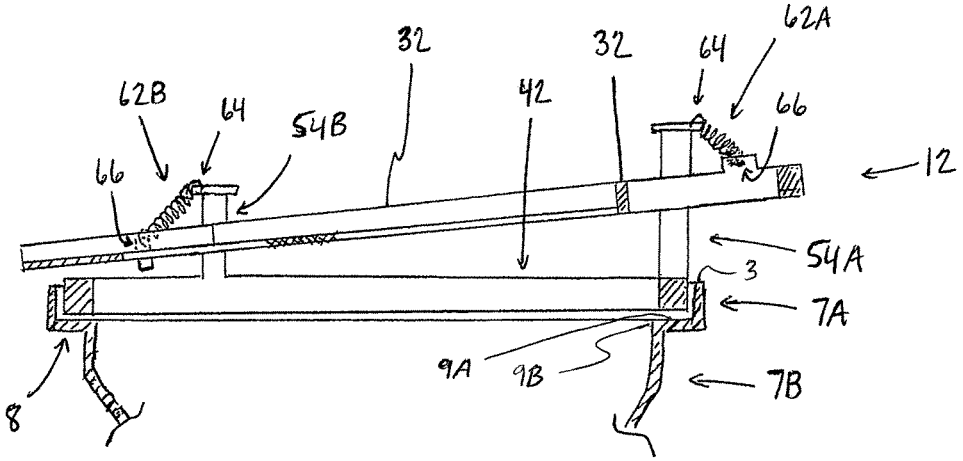
FIG. 3 is a cross-sectional view of the vibrating screen in FIG. 2 along line A-A.

Turning now to the vibrating device 18, the vibrating device is arranged for vibrating the screen relative to the inlet hopper of the auger. The vibrating device comprises a housing 68. The vibrating device also includes a motor and a mass disposed eccentrically along a shaft of the motor. The motor and the mass are enclosed within the housing such that moving parts of the vibrating device are contained entirely within the housing. In the illustrated embodiment, the vibrating device is operable at a plurality of selectable speeds within a range of speeds. The vibrating device is typically operated in an operating mode comprising a continuous running mode in which the motor operates continuously; other embodiments may comprise other operating modes such as an intermittent running mode in which the motor operates intermittently. The vibrating device also includes a controller 70 for switching into the continuous running mode and for selecting one of the selectable speeds. The vibrating device is mounted on the mounting plate 34 of the screen such that the housing, motor, and mass are supported on the screen 12. As such, vibration of the vibrating device effects vibration of the screen. Configuration of the springs in respective orientations having both longitudinal and lateral extents as shown in FIGS. 2-3 (in addition to upright extents of the orientations of the springs) such that the screen is supported laterally centrally between the pairs of upright members 54 of the mounting assembly results in pendulum like support of the screen. That is, when the screen is displaced in a longitudinal or a transverse direction thereto, the configuration of the springs as shown in FIGS. 2-3 such the screen is supported centrally between the upright members effects a tendency of the screen to return generally towards its equilibrium position without any additional components.

In use, the vibrating screen is mounted in the inlet hopper of the auger. The frame 42 of the mounting assembly is lowered onto the flange 8 of the inlet hopper so as to be supported thereon. The posts 56 are slidably received in the upright members 54 of the frame in the working position. The vibrating device 18 is mounted to the screen on the mounting plate 34 thereof. The screen is positioned generally over the inlet opening 4 of the inlet hopper of the auger and above the frame and generally below the upper portions of the posts. The springs 62, being supported at the second spring ends 66 on the attachment flanges 38 of the screen respectively, are attached at the first spring ends 64 to corresponding ones of the upper portions 60 of the posts.

The inlet hopper of the auger with the vibrating screen mounted therein is placed under a discharge opening of a storage container at a bottom thereof. The storage container contains the particulate material, such as fertilizer, in a container body. The storage container is generally supported on legs so as to stand upwardly from a support surface such that the inlet hopper may be placed beneath the discharge opening and generally beneath the container body.

The vibrating device is switched into the continuous running mode with the controller 70 such that the screen begins to vibrate at one of the selectable speeds. The discharge opening of the storage container is opened so that the particulate material contained therein falls onto the first mesh portion 26 of the vibrating screen. The particles which are loose pass through the openings in the first mesh portion. Vibration of the screen 12 effects freeing of the loose particles which have bridged upon the first mesh portion. The side flanges 32 of the screen substantially contain the particulate material generally over the first mesh portion especially when the particles may form a pile on the first mesh portion. Furthermore, the vibration of the screen effects breaking up of softer clumps of the particulate material substantially into loose particles before passing through the first mesh portion. Clumps of the particulate material that are not broken up by the vibration of the screen are moved by the vibration downwardly across the screen generally from the first end 28 of the first mesh portion towards the second end 30 thereof. The clumps continue to move downwardly across the second portion 36 of the screen and are guided into the receptacle substantially below the screen for collecting the clumps of the particulate material therein. The end portions of the side flanges along the screen sides help funnel the clumps into the receptacle. As the screen 12 vibrates, the mounting assembly 14 remains substantially stationary and the vibration of the screen is not conducive to vibration of the inlet hopper 1. Consequently, the vibration of the screen may not stress components of the vibrating screen 10 or the inlet hopper, potentially improving useful life of at least one of the vibrating screen and inlet hopper and potentially reducing maintenance of at least one thereof.

In the aforementioned manner, the fertilizer particles that are loose and thus suitable for application to crops pass through the inlet hopper and into the auger 2, which loads the fertilizer onto another piece of equipment such as a trailer, tractor, or truck. For storage of the vibrating screen 10 or for using the inlet hopper 1 without the vibrating screen mounted thereon, the vibrating screen may be removed from the inlet hopper by raising the vibrating screen out of the inlet hopper since the device is not fastened thereto.

In an alternative embodiment, the screen mounting elements are integral with the upright members 54 such that the upper portion of the respective post and the corresponding upright member collectively define a unitary screen mounting element of the alternative embodiment.

In other embodiments, the attachment flanges 38 may be integral with respective screen sides 24 and the elongate attachment member 40. In yet further embodiments, the attachment flanges may be entirely integral with the screen frame.

In further alternative embodiments, the upper portion 60 of each post has a plurality of openings spaced apart from one another in a semicircular arrangement along an outermost portion of the circular peripheral edge of the upper portion. The first spring end 64 of each spring is arranged to be attached at one of the openings of the upper portion. Remaining ones of the openings in each upper portion afford adjustment of a position of the corresponding first spring end.

In a further different embodiment, the vibrating screen may be supported above a conveyor by a support structure comprising a support frame having upper edges defining an outer periphery of the support structure and an inner shoulder around the outer periphery projecting inwardly from the upper edges. The support structure also includes a plurality of upstanding legs extending downwardly from the support frame for holding the support frame above the conveyor.

In yet another embodiment, the resilient elements of the suspension system may comprise shocks, struts, or other elongate structures which are resilient.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A vibrating screen in combination with an inlet hopper of a conveyor for screening particulate material fed into the inlet hopper, the inlet hopper comprising:

side walls which define upper edges of the inlet hopper, the upper edges being disposed around a periphery of the inlet hopper and delimiting an inlet opening at or adjacent a top of the inlet hopper;

the side walls having upper portions which locate the upper edges at respective tops of the upper portions;

the side walls further including inner shoulders extending inwardly from the upper portions of the side walls at locations spaced below the upper edges, the inner shoulders defining upper support surfaces and terminating at edges spaced inwardly from the upper portions that delimit an opening sized smaller than the inlet opening;

the vibrating screen comprising:

a screen spanning longitudinally between first and second screen ends and laterally between opposing screen sides which join the first and second screen ends, the screen having openings sized to receive at least individual particles of the particulate material therethrough;

a mounting assembly arranged for removably mounting to the inlet hopper of the conveyor;

a suspension system resiliently supporting the screen on the mounting assembly such that the screen spans across at least a portion of the inlet opening;

a vibrating device arranged for vibrating the screen relative to the inlet hopper of the conveyor;

the mounting assembly comprising a frame removably supported on the inner shoulders of the side walls of the inlet hopper;

the frame defining a bottom surface along a periphery of the frame that is disposed in removable contact with the upper support surfaces of the inner shoulders;

an inner side of the frame defined inwardly of the bottom surface delimiting an opening through which the particulate material can pass from the screen to the inlet hopper; and an outer side of the frame defined outwardly of the bottom surface and opposite to the inner side being sized and shaped in a manner substantially matching the upper portions of the side walls of the inlet hopper so that the outer side of the frame is substantially disposed in removable contact with the upper portions of the side walls to resist movement of the frame relative to the inlet hopper when the screen is vibrating.

2. The vibrating screen according to claim 1, wherein the mounting assembly further comprises mounting elements connected to the frame and disposed at least substantially above the screen and the suspension system comprises a plurality of resilient elements at spaced locations about the screen, the resilient elements extending downwardly from the mounting elements to the screen.

3. The vibrating screen according to claim 2, wherein the mounting elements are located outwardly of an outer periphery of the screen collectively defined by the first and second screen ends and the screen sides and the resilient elements also extend inwardly from the mounting elements to the screen.

4. The vibrating screen according to claim 2, wherein the resilient elements comprise springs.

5. The vibrating screen according to claim 1, wherein the vibrating device comprises a motor and an eccentric mass supported on the screen.

6. The vibrating screen according to claim 1, wherein the inner side of the frame is sized larger than an inner dimension of the inlet hopper defined between the edges of the inner shoulders.

7. The vibrating screen according to claim 1, wherein the screen further comprises a first mesh portion within an outer periphery of the screen collectively defined by the first and second screen ends and the screen sides and side flanges along the outer periphery of the screen, the first mesh portion locating the openings therein and the side flanges extending upwardly from the first mesh portion.

8. The vibrating screen according to claim 7, wherein the side flanges taper inwardly from the screen sides towards one another towards the second screen end.

9. The vibrating screen according to claim 1, wherein the screen further comprises a first mesh portion within an outer periphery of the screen collectively defined by the first and second screen ends and the screen sides and a second portion extending outwardly from the first mesh portion at or adjacent the second screen end and having a free edge for guiding material into a receptacle below the screen, the second portion being free of openings or having openings sized smaller than the individual particles of the particulate material so as to resist passage of the individual particles therethrough.

10. The vibrating screen according to claim 1, wherein the first screen end is elevated relative to the second screen end at a slope.

11. The vibrating screen according to claim 10, wherein at least one of the first or second screen ends is arranged to be raised or lowered such that the slope is adjustable.

12. A vibrating screen for screening particulate material fed into a conveyor, the vibrating screen comprising:

a screen spanning longitudinally between first and second screen ends and laterally between opposing screen sides which join the first and second screen ends, the screen having openings sized to receive at least individual particles of the particulate material therethrough;

a mounting assembly arranged to be supported above the conveyor, the mounting assembly comprising mounting elements disposed at least substantially above the screen;

the mounting elements being located outwardly of an outer periphery thereof collectively defined by the first and second screen ends and the screen sides;

a plurality of resilient elements interconnecting the mounting elements and the screen at spaced locations about the screen, the resilient elements extending downwardly and laterally inwardly from the mounting elements to the screen such that the screen is supported on the mounting assembly to span over a portion of the conveyor;

each of the resilient elements extending from a corresponding one of the mounting elements to the screen in a longitudinal direction which is opposite to that of at least another one of the resilient elements so as to cooperate to suspend the screen at a substantially fixed location above the conveyor; and a vibrating device arranged for vibrating the screen relative to the mounting assembly.

13. The vibrating screen according to claim 12, wherein the resilient elements comprise springs.

14. The vibrating screen according to claim 12, wherein the first screen end is elevated relative to the second screen end at a slope.

15. The vibrating screen according to claim 14, wherein at least one of the first or second screen ends is arranged to be raised or lowered such that the slope is adjustable.

16. The vibrating screen according to claim 12, wherein the screen further comprises a first mesh portion within the outer periphery of the screen and side flanges along the outer periphery of the screen, the first mesh portion locating the openings therein and the side flanges extending upwardly from the first mesh portion and supporting lower ends of the resilient elements.

17. The vibrating screen according to claim 16, wherein the side flanges taper inwardly from the screen sides towards one another towards the second screen end.

18. The vibrating screen according to claim 12, wherein the screen further comprises a first mesh portion within the outer periphery of the screen and a second portion extending outwardly from the first mesh portion at or adjacent the second screen end and having a free edge for guiding material into a receptacle below the screen, the second portion being free of openings or having openings sized smaller than the individual particles of the particulate material so as to resist passage of the individual particles therethrough.

* * * * *